US007731041B2

(12) United States Patent
Gredel et al.

(10) Patent No.: US 7,731,041 B2
(45) Date of Patent: Jun. 8, 2010

(54) GANTRY STACKER WITH TWO SIDE-BY-SIDE SPREADERS

(75) Inventors: Martin Gredel, Würzburg (DE); Hubert Foltys, Bieberehren (DE)

(73) Assignee: Noell Mobile Systems GmbH, Würzburg (DE)

( * ) Notice: Subject to any disclaimer, the term of this patent is extended or adjusted under 35 U.S.C. 154(b) by 0 days.

(21) Appl. No.: 12/152,018

(22) Filed: May 12, 2008

(65) Prior Publication Data

US 2009/0097935 A1 Apr. 16, 2009

(30) Foreign Application Priority Data

Oct. 11, 2007 (DE) ..... 10 2007 049 012

(51) Int. Cl.
*B66C 17/20* (2006.01)

(52) U.S. Cl. ..... 212/344; 212/316; 212/345; 414/460

(58) Field of Classification Search ..... 212/343–345, 212/316; 414/460
See application file for complete search history.

(56) References Cited

U.S. PATENT DOCUMENTS

| | | | | |
|---|---|---|---|---|
| 3,247,974 | A * | 4/1966 | Dechantsreiter | 414/591 |
| 3,482,720 | A * | 12/1969 | Tax et al. | 414/460 |
| 3,558,172 | A * | 1/1971 | Lamer et al. | 294/81.2 |
| 3,759,409 | A * | 9/1973 | Wenzel et al. | 414/460 |
| 4,279,347 | A * | 7/1981 | Appleman | 212/274 |
| 4,358,020 | A * | 11/1982 | Thiele | 212/276 |
| 4,480,714 | A | 11/1984 | Yabuta et al. | |
| 4,599,030 | A * | 7/1986 | Skaalen et al. | 414/460 |
| 4,747,745 | A * | 5/1988 | Pippen et al. | 414/460 |
| 4,838,438 | A * | 6/1989 | Ishige et al. | 212/284 |
| 5,718,550 | A * | 2/1998 | Lanigan et al. | 414/140.3 |
| 5,893,471 | A * | 4/1999 | Zakula | 212/345 |
| 6,530,492 | B2 | 3/2003 | Weis | |
| 7,032,763 | B1 * | 4/2006 | Zakula et al. | 212/344 |
| 7,070,060 | B1 * | 7/2006 | Feider et al. | 212/291 |
| 7,546,929 | B2 * | 6/2009 | Wierzba et al. | 212/345 |

FOREIGN PATENT DOCUMENTS

| | | |
|---|---|---|
| DE | 32 22 149 | 11/1983 |
| DE | 196 41 045 A1 * | 9/1998 |
| DE | 197 26 359 | 12/1998 |
| DE | 103 55 946 | 7/2005 |
| EP | 0 960 067 | 12/1999 |
| WO | WO 01/62657 | 8/2001 |
| WO | WO 03/104132 | 12/2003 |
| WO | WO 2005/090223 | 9/2005 |
| WO | WO 2006/083230 | 8/2006 |

* cited by examiner

*Primary Examiner*—Thomas J. Brahan
(74) *Attorney, Agent, or Firm*—Collard & Roe, P.C.

(57) ABSTRACT

A gantry stacker for transporting and stacking freight containers consists of two chassis beams with steerable wheels, supports, a hoist, an overhead frame, a lifting beam a driver's cab and engines. There are at least two spreaders that are movable in a horizontal direction independent of each other and are disposed in a side-by-side relationship on a lifting beam. Containers deposited directly side-by-side with no gap there between may be gripped, transported and separated or that spaced-apart containers with an alley may be gripped, transported and moved toward each other so that they may be readily transported further, using multispreader systems. Containers of different heights may be gripped and transported. The lifting height allows for straddling containers standing on the floor with attached and lifted containers.

10 Claims, 2 Drawing Sheets

GANTRY STACKER WITH TWO SIDE-BY-SIDE SPREADERS

CROSS REFERENCE TO RELATED APPLICATIONS

Applicants claim priority under 35 U.S.C. §119 of German Application No. 10 2007 049 012.9 filed Oct. 11, 2007.

BACKGROUND OF THE INVENTION

1. Field of the Invention

The invention relates to a gantry stacker for transporting and stacking freight containers. The invention may be used whenever several containers are deposited in a close side-by-side relationship by a crane in transhipment ports and whenever it is necessary to transport, stack or position the side-by-side freight containers for conventional gantry stackers to ensure further shipment.

2. The Prior Art

On transhipment docks, in particular in port facilities, containers are usually picked up, transported and when necessary stacked on the ship or in the port facility by means of gantry crane spreaders for loading and unloading ships. Such a gantry crane has been described in German Patent No. DE 197 26 359 A1 for example.

Containers that have been deposited in the port facility are next picked up by gantry lift trucks and transhipped to the port facility where they are loaded onto other vehicles such as road vehicles or stacked appropriately.

German Patent No. DE 32 221 49 A1 describes a gantry stacker for picking up containers and for transporting them. These vehicles are suited for picking up superposed containers and have therefor a corresponding height. On either side of two chassis beams there are at least two, but often even several steerable wheels. These chassis beams have to be of a narrow implementation for the gantry stacker to be capable of traveling between the containers in narrow alleys. For this reason, these chassis beams are often configured so that engines, gears and other parts needed for displacement are disposed therein. Usually, two supports are located on the chassis beams. On the supports are located the hoist, the overhead frame, the driver's cab and engines usually constituting combustion engines, e.g., diesel engines, supplying the current for the drive in the wheels.

A spreader for taking hold of containers and for transporting them on a gantry lift truck has been described in German Patent No. DE 103 55 946.9. This spreader is not only slidable laterally but also movable alongside the container so that the gantry lift truck needs not correct mispositions by traveling moves.

Spreaders disposed one behind the other and by means of which two 20 foot containers are transportable are described in International Application WO 01/62657 A1. The spreader apparatus proposed is also suited for taking hold of and for stacking very long containers.

In order to increase the transport capacity in port facilities, gantry stackers have been developed with a spreader that can pick up and transport two containers standing behind each other. Such gantry cranes have been described in European Patent No. EP 0 960 067 B1 for example.

In order to increase the transport capacity in the port facility, gantry stackers have been developed with a longer spreader for several containers to be transported, standing one behind the other. Such stackers are known from literature. Recent developments for dealing with even higher container handling rates provide for the gantry or ship-to-shore cranes to be equipped with what are termed tandem spreader systems. These tandem spreader systems are used to take hold of several, preferably two, side-by-side 40 feet freight containers or four 20 feet containers standing side-by-side and behind each other, and to transport them from the port facility to the ship or from the ship to the port facility.

For shore-to-ship transport, this implies that several containers are placed so as to stand side-by-side for the tandem spreader system of the ship-to-shore crane to take hold of them. After simultaneous ship-to-shore transport of several containers, further transportation of the containers deposited on the shore can occur in a fast and reliable way, since too slow transport in the port will limit the unloading speed of the gantry crane. In their actual mode of construction, the known gantry stackers for transporting and stacking freight containers however are not capable of transporting two containers standing side-by-side, since there is no alley between them for the traveling beam to pass. Further, their hoists are not suited for separating two containers standing side by side.

International Application No. WO 2005/090223 A1 describes a spreader system for taking hold of containers and for transporting them by means of which two containers disposed in a side-by-side relationship are taken hold of and transported. In the normal state, both spreaders are solidly joined together. There is however also the possibility to separate the two spreaders with a hydraulic device and to deposit containers at a certain distance from each other. Another possibility is to take hold of two containers and to deposit them independent of each other. However, this requires two trolleys that can travel independently of each other. Further, a hydraulic mechanism is disposed in the upper region of the spreader so that the spreader has a great overall height. For gantry cranes, this overall height is not problematic but is a problem when utilized on a gantry stacker, because it increases the height of the gantry stacker, which should not exceed certain overall heights.

International Application Nos. WO 2006/083230 A1 and WO 03/104132 A1 describe other solutions in which side-by-side spreaders are capable of being moved apart or toward each other by means of lifting mechanisms in order to transport containers. As a result, containers standing together can be taken hold of, separated from each other and then deposited again. Irrespective of the fact that such lifting mechanisms consist of a plurality of parts and are of high weight and prone to failure as a result thereof, they suffer from the drawback of being disposed above the spreader so that they are not suited for being mounted in gantry stackers which have limited weight and overall height.

It is not possible to travel over two superimposed containers, because conventional gantry stackers are designed to have the width of one container. With the appearance of tandem spreader systems on ship-to-shore cranes and with their use for handling freight containers, the need arose to provide for a space-saving possibility of transporting and depositing freight containers so that they may be disposed in a close side-by-side relationship when picked up and reliably transported by spreader systems, and so that they may be separated from each other for conventional gantry stackers to be capable of moving and transporting them.

SUMMARY OF THE INVENTION

The solution of the invention provides for a gantry stacker for transporting and stacking freight containers consisting of two chassis beams with steerable wheels, supports, a hoist, an overhead frame, driver's cab and engines. There are at least two spreaders that are travelable in a horizontal direction independent of each other and disposed side-by-side on the lifting beam. On this vehicle, two gantries abut on a right and on a left chassis frame, thus allowing the containers to be transported to be straddled. A platform mounted in the top region of the gantries offers space for the power train and the hoist. The apparatus is operated by the driver of the vehicle and is capable of grasping containers having several spreaders, preferably two, hanging thereon, and of lifting them with one common rope hoist. The spreaders are mounted each in one common lifting beam at the front and at the back and are movable sideways independent of each other. With this construction, the two spreaders can be implemented to be flat so that the gantry stacker may be of a small height. The sideways mobility is configured such that the containers may be moved apart before depositing them so that the alley needed for a conventional straddle carrier can be opened before depositing the containers. Accordingly, parallel standing containers spaced a greater distance apart may be lifted and moved together and be moved from a pre-stacking area to the place at which the freight containers are picked up by the spreader system of the gantry crane for loading ship-to-shore cranes. The suspension of the spreaders in the lifting beams is constructed such that containers of different height may be lifted with the possible height difference amounting to up to one foot.

It is advantageous to mount eight steered and individually spring-mounted wheels on the chassis frame, at least four wheels being driven and at least four wheels being braked. Another advantage is to mount one single diesel engine as an energy source. The drive system may be configured both electrically and hydraulically. The rope hoist is suited for driving both grabbing means, which constitute spreaders. The spreaders are suspended at the front and at the back on one common lifting beam. Due to the gantry construction, two side-by-side containers or four containers of which two are respectively standing one directly behind the other, can be straddled and transported. The container grabber means, preferably spreaders, are not only independently displaceable in the lifting beams, but are also configured to be horizontally rotatable.

It is advantageous that the suspensions of the container grabber means are configured to be so flexible that different container heights and inaccurate positions are equaled out. Such solutions are known from conventional spreaders on gantry stackers.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
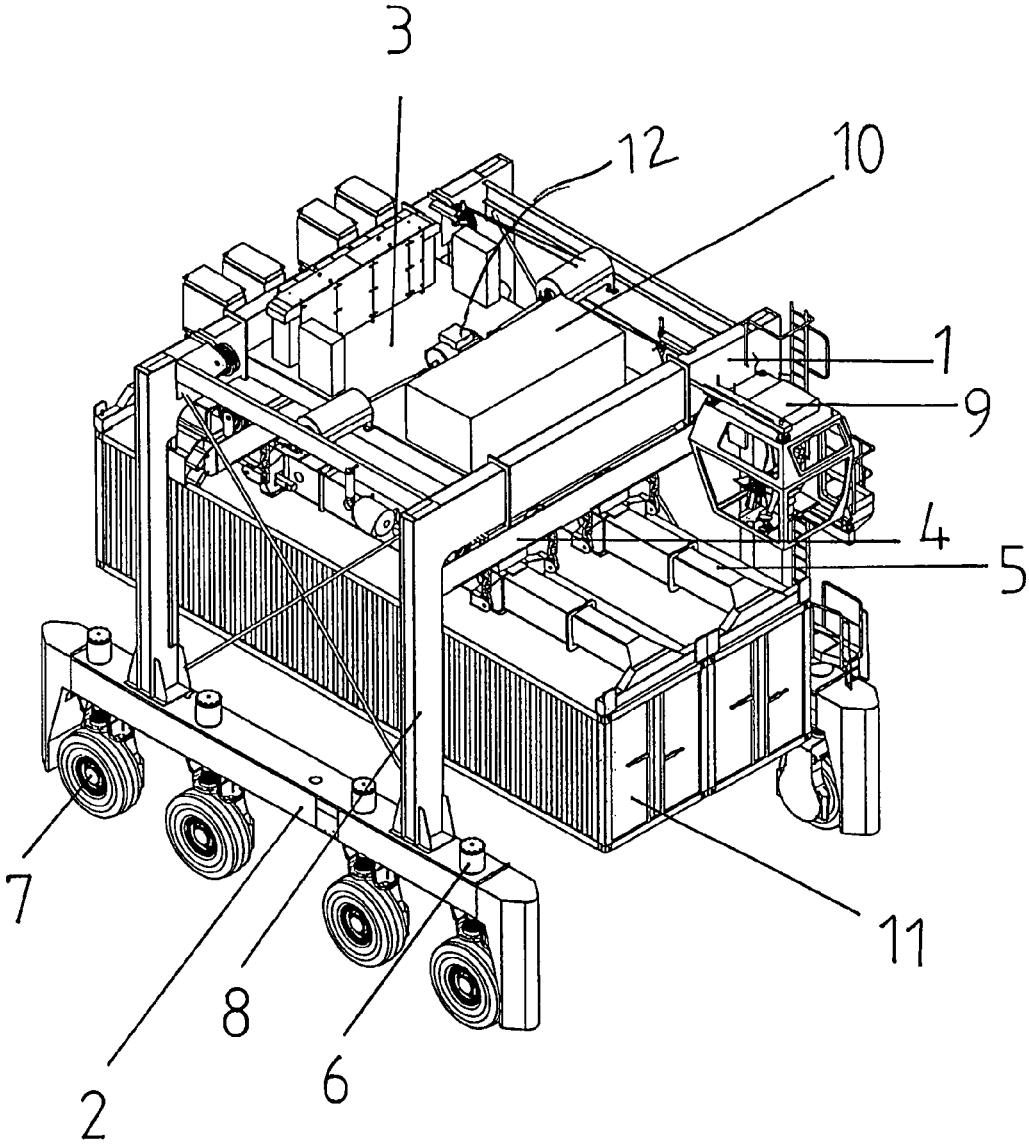
FIG. 1 shows gantry stackers with two lifted side-by-side containers.

Referring now in detail to the drawings, FIG. 1 shows a gantry stacker for transporting and stacking freight containers consisting of the two chassis frames 2 on which there are disposed springs 6 and four wheels 7 on each frame. All four wheels are steerable, with two of wheels 7 at least being driven and at least two wheels 7 being braked on either side. Supports 8 run from the two chassis frames 2 to gantry 1 on which there are disposed driver's cab 9 and platform 3. On platform 3, there is disposed a diesel engine or an alternative, independent energy source of the corresponding performance for delivering the electric power needed for driving wheels 7. Two spreaders 5 are disposed on lifting beams 4, said spreaders being movable in a horizontal direction, independent of each other. The gantry stacker straddles two side-by-side containers 11 deposited by a ship-to-shore crane with tandem spreader system and grabs them with its spreaders 5, lifts them with common rope hoist 12 and brings them to a site provided for this purpose. Prior to putting them down, preferably during the travel, the two spreaders 5 travel on lifting beam 4 so that containers 11 are spaced a distance apart and form an alley that may be straddled by conventional gantry stackers.

Figure 2:
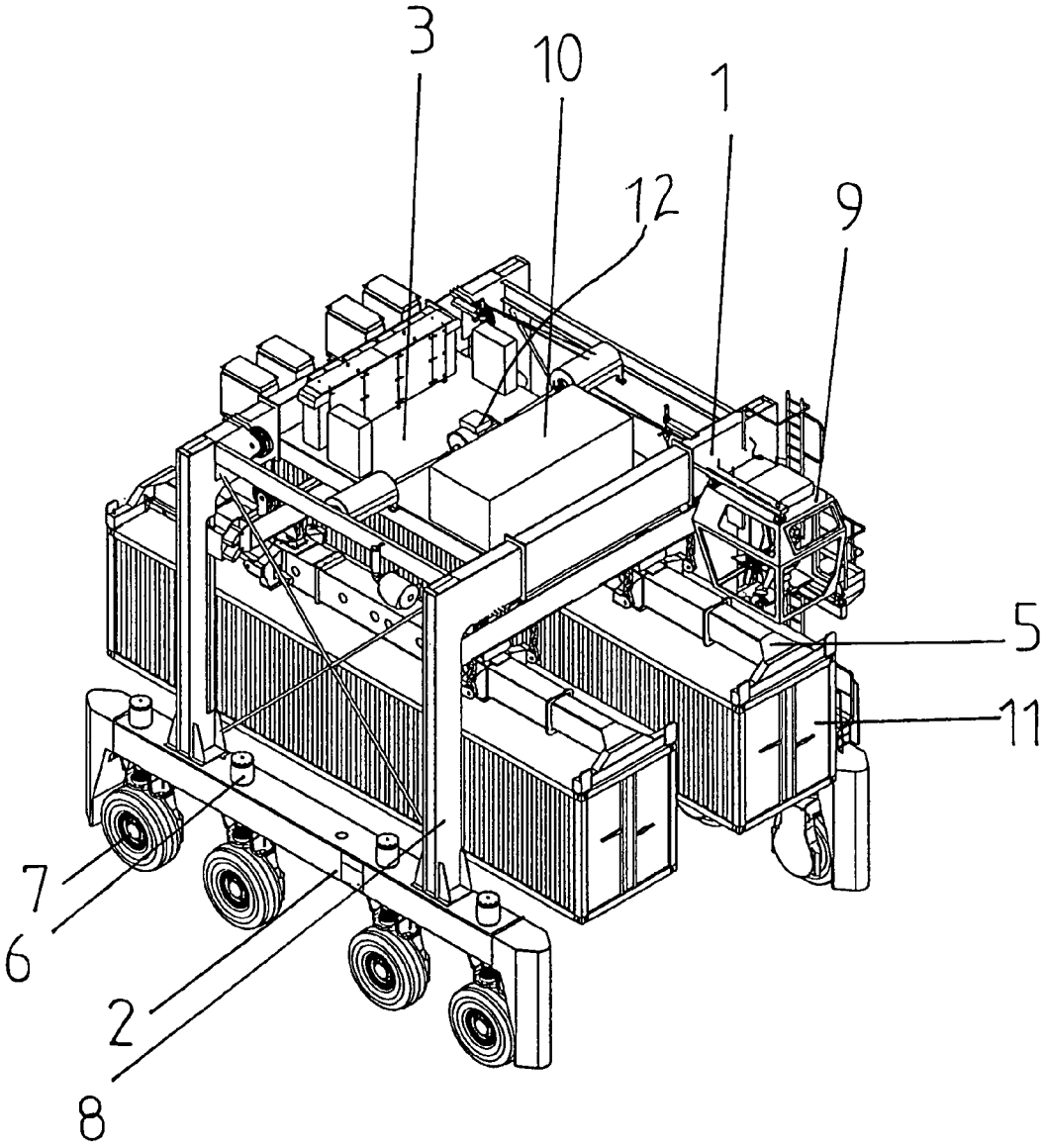
FIG. 2 shows gantry stackers with two side-by-side containers with the spreaders having been moved toward the chassis frames.

Such a position is shown in FIG. 2.

The solution proposed has the advantage that containers 11 deposited directly side-by-side with no gap there between may be gripped, transported and separated or that spaced-apart containers with an alley may be gripped, transported and moved toward each other so that they may be readily transported further, using multispreader systems. Containers of different heights may be gripped and transported. The lifting height allows for straddling containers standing on the floor with attached and lifted containers 16.

Accordingly, while only a few embodiments of the present invention have been shown and described, it is obvious that many changes and modifications may be made thereunto without departing from the spirit and scope of the invention.

LIST OF THE REFERENCE NUMERALS USED

1 Gantry
2 Chassis frame
3 Platform
4 Lifting beam
5 Spreader
6 Springs
7 Wheels
8 Supports
9 Driver's cab
10 Diesel engine
11 Container

What is claimed is:

1. A gantry stacker for transporting and stacking freight containers, comprising:

two chassis beams;

steerable wheels mounted on each of the beams;

supports mounted on each of the beams;

two lifting beams mounted between the supports and transversely to the chassis beams;

a hoist for raising and lowering the lifting beams;

an overhead frame mounted on the supports;

a driver's cab mounted to the overhead frame;

engines mounted to the overhead frame; and at least two spreaders that are movable in a horizontal direction independent of each other, said spreaders being disposed in a side-by-side relationship on the lifting beams.

2. The gantry stacker as set forth in claim 1, wherein the wheels are individually spring-mounted.

3. The gantry stacker as set forth in claim 1, wherein at least four of the wheels are driven wheels.

4. The gantry stacker as set forth in claim 1, wherein at least four of the wheels are configured to be braked.

5. The gantry stacker as set forth in claim 1, wherein the engine is a diesel engine.

6. The gantry stacker as set forth in claim 1, further comprising an electrical drive system.

7. The gantry stacker as set forth in claim 1, further comprising a hydraulic drive system.

8. The gantry stacker as set forth in claim 1, wherein the hoist is a common rope hoist for both spreaders.

9. The gantry stacker as set forth in claim 1, wherein the spreaders are suspended on one of the lifting beams at a front of the spreaders and on the other lifting beam at a back of the spreaders.

10. The gantry stacker as set forth in claim 1, wherein the spreaders are constructed such that two containers standing directly side by side and two containers standing directly behind each other may be straddled and transported by the gantry stacker.

* * * * *